US010147520B2

(12) United States Patent
Ranganathan et al.

(10) Patent No.: US 10,147,520 B2
(45) Date of Patent: Dec. 4, 2018

(54) HIGH VISIBILITY CABLE

(71) Applicant: GENERAL CABLE TECHNOLOGIES CORPORATION, Highland Heights, KY (US)

(72) Inventors: Sathish Kumar Ranganathan, Indianapolis, IN (US); Sujith Murali, Chesterfield, NJ (US); Jon Michael Malinoski, Zionsville, IN (US); Scott Edward Frankowski, Fishers, IN (US); Srinivas Siripurapu, Carmel, IN (US); Vijay Mhetar, Carmel, IN (US); Barry Eugene Lawson, Marion, IN (US)

(73) Assignee: General Cable Technologies Corporation, Highland Heights, KY (US)

( * ) Notice: Subject to any disclaimer, the term of this patent is extended or adjusted under 35 U.S.C. 154(b) by 0 days.

(21) Appl. No.: 14/581,340

(22) Filed: Dec. 23, 2014

(65) Prior Publication Data

US 2015/0179307 A1 Jun. 25, 2015

Related U.S. Application Data

(60) Provisional application No. 61/920,035, filed on Dec. 23, 2013.

(51) Int. Cl.
*H01B 7/00* (2006.01)
*H01B 7/36* (2006.01)
(Continued)

(52) U.S. Cl.
CPC ..... *H01B 7/36* (2013.01); *H01B 3/30* (2013.01); *H01B 3/40* (2013.01); *H01B 3/421* (2013.01);
(Continued)

(58) Field of Classification Search
CPC ..... H01B 7/363; H01B 7/365; H01B 7/366
(Continued)

(56) References Cited

U.S. PATENT DOCUMENTS 2,567,233 A * 9/1951 Palmquist ..... A41D 31/0016 359/518
2,984,596 A 5/1961 Franer
(Continued)

FOREIGN PATENT DOCUMENTS

EP 0829884 * 8/1997
EP 0924711 A2 6/1999
(Continued)

OTHER PUBLICATIONS

Young, Lee W.; International Search Report and Written Opinion of the International Searching Authority, issued in International Application No. PCT/US2014/072185; dated Mar. 12, 2015; 8 pages.
(Continued)

*Primary Examiner* — Chau N Nguyen
(74) *Attorney, Agent, or Firm* — Ulmer & Berne LLP

(57) ABSTRACT

An electrical cable includes a plurality of conductors forming a conductor core, one or more insulation layers at least partially surrounding at least one of the plurality of conductors, an outer jacket surrounding the conductor core and a film applied to the exterior surface of the outer jacket. The film includes high visibility particles. Methods of forming electrical cables are also described herein.

15 Claims, 2 Drawing Sheets

(51) Int. Cl.

| | |
|---|---|
| ***H01B 19/04*** | (2006.01) |
| ***H01B 13/14*** | (2006.01) |
| ***H01B 3/44*** | (2006.01) |
| ***H01B 3/30*** | (2006.01) |
| ***H01B 3/46*** | (2006.01) |
| ***H01B 3/42*** | (2006.01) |
| ***H01B 3/40*** | (2006.01) |
| *H01B 7/04* | (2006.01) |

(52) U.S. Cl.
CPC ..... *H01B 3/442* (2013.01); *H01B 3/443* (2013.01); *H01B 3/445* (2013.01); *H01B 3/447* (2013.01); *H01B 3/46* (2013.01); *H01B 13/141* (2013.01); *H01B 13/145* (2013.01); *H01B 19/04* (2013.01); *H01B 7/041* (2013.01)

(58) Field of Classification Search
USPC ..... 174/112
See application file for complete search history.

(56) References Cited

U.S. PATENT DOCUMENTS

| | | | | |
|---|---|---|---|---|
| 3,225,131 | A | 12/1965 | Conklin et al. | |
| 3,551,542 | A | 12/1970 | Perrone | |
| 4,415,518 | A | 11/1983 | Pochurek et al. | |
| 4,697,407 | A * | 10/1987 | Wasserman | D01D 5/42 428/372 |
| 5,034,275 | A * | 7/1991 | Pearson | B29C 51/14 428/336 |
| 5,082,995 | A * | 1/1992 | Paterson | H01B 7/28 174/110 R |
| 5,286,922 | A | 2/1994 | Curtiss | |
| 5,357,058 | A | 10/1994 | Tanihira et al. | |
| 5,935,694 | A | 8/1999 | Olmstead et al. | |
| 6,254,831 | B1 * | 7/2001 | Barnard | G01N 21/6428 250/458.1 |
| 6,355,349 | B2 | 3/2002 | Chizmas | |
| 6,368,684 | B1 | 4/2002 | Onishi et al. | |
| 6,596,943 | B1 | 7/2003 | Ward | |
| 6,843,008 | B2 | 1/2005 | Mellgren | |
| RE41,593 | E | 8/2010 | Ryeczek | |
| 8,420,217 | B2 * | 4/2013 | Johnson | B32B 7/06 428/343 |
| 8,454,785 | B1 | 6/2013 | Bennett et al. | |
| 8,540,836 | B1 | 9/2013 | Hardin et al. | |
| 9,343,200 | B2 * | 5/2016 | Perez-Sanchez | H01B 7/295 |
| 2006/0237132 | A1 | 10/2006 | Stotz | |
| 2007/0189696 | A1 * | 8/2007 | Van Koetsem | G02B 6/3897 385/137 |
| 2008/0277138 | A1 | 11/2008 | Gallens et al. | |
| 2010/0282491 | A1 * | 11/2010 | Cofre Luna | G02B 6/4482 174/113 R |
| 2013/0037304 | A1 | 2/2013 | Ikeda et al. | |
| 2015/0115792 | A1 * | 4/2015 | Kuo | H01B 3/30 313/483 |

FOREIGN PATENT DOCUMENTS

| | | | |
|---|---|---|---|
| GB | 2375322 | B | 3/2004 |
| JP | 11-148115 | A1 | 6/1999 |
| JP | 11-288627 | A | 10/1999 |
| JP | 2000-123644 | A | 4/2000 |
| JP | 2006-99964 | A | 4/2006 |
| JP | 2011-9181 | A | 1/2011 |
| WO | WO 82/03942 | * | 11/1982 |
| WO | 02/098177 | A1 | 12/2002 |
| WO | 2010058385 | A1 | 5/2010 |
| WO | 2010131084 | A2 | 11/2010 |

OTHER PUBLICATIONS

Lopez, Viviana Villar; Examination Report issued in Chilean Patent Application No. 2016-001628; dated Aug. 17, 2017; 24 pages including English translation.

* cited by examiner

HIGH VISIBILITY CABLE

REFERENCE TO RELATED APPLICATION

The present application claims priority of U.S. provisional application Ser. No. 61/920,035, entitled ELECTRICAL MINING CABLE WITH HIGH VISIBILITY JACKET, filed Dec. 23, 2013, and hereby incorporates the same application herein by reference in its entirety.

TECHNICAL FIELD

The present disclosure generally relates to cables, such as electrical cables, that provide for increased visibility. The cables incorporate high visibility particles onto an outer jacket of a cable.

BACKGROUND

Currently, various types of reflective tapes are applied to the exterior of electrical cables to increase their visibility in low-light environments. For example, mining cables which are used both underground and above ground applications should be highly visible to inspectors and workers to avoid unintentional damage, maintain safety, and facilitate repairs. Existing reflective tapes, however, suffer from several drawbacks. For example, mining cables with reflective tapes are subject to extreme environmental conditions which can weaken the adhesive that bonds the reflective tape to the cable and can cause the tape to peel off. Additionally, abrasion can damage or impair the visibility of the reflective tape. Accordingly, there is a need for a durable cable jacket that can remain highly visible under demanding conditions. Cables which are able to withstand harsh mining conditions, and which are easily-cleanable so as to maintain their high visibility, are also desirable.

SUMMARY

In accordance with one embodiment, an electric cable includes a plurality of conductors forming a conductor core, one or more insulation layers, an outer jacket surrounding the conductor core, and a film. The one or more insulation layers at least partially surround at least one of the plurality of conductors. The outer jacket includes an exterior surface. The film is applied to the exterior surface of the outer jacket and includes high visibility particles.

In accordance with another embodiment, a method of forming an electric cable includes providing a plurality of conductors to form a conductor core; applying one or more insulation layers to at least partially surround at least one of the plurality of conductors; extruding an outer jacket to surround the conductor core, the outer jacket including an exterior surface; and applying a film to an exterior surface of the outer jacket. The film includes high visibility particles.

DETAILED DESCRIPTION

An electrical cable exhibiting increased visibility can generally include a plurality of conductors, one or more insulation layers, and an outer jacket. The outer jacket can be highly visible, especially in low-light environments, while maintaining high abrasion resistance and cleanability. As can be appreciated, the jacket can be used on any type of electrical cable in which high visibility and abrasion resistance are desired, including, for example, mining cables.

Cable Components

Figure 1A:
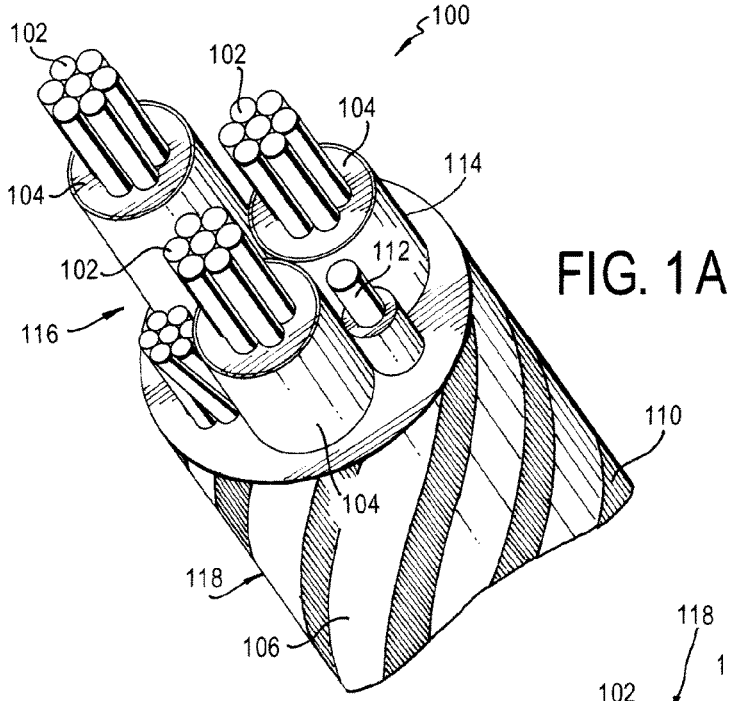
FIG. 1A depicts a perspective view of an electric cable according to one embodiment.
Figure 1B:
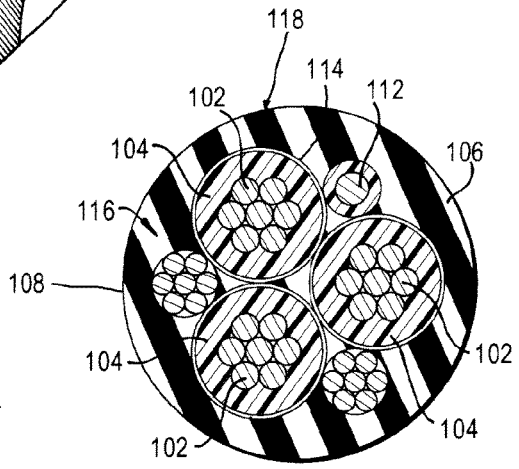
FIG. 1B depicts a cross-sectional end view of the electric cable of FIG. 1A.
Figure 2:
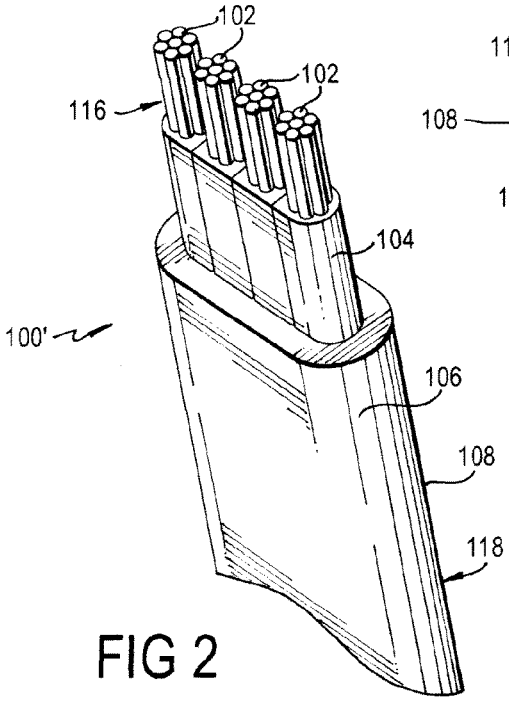
FIG. 2 depicts a perspective view of an electric cable according to one embodiment.
Figure 3:
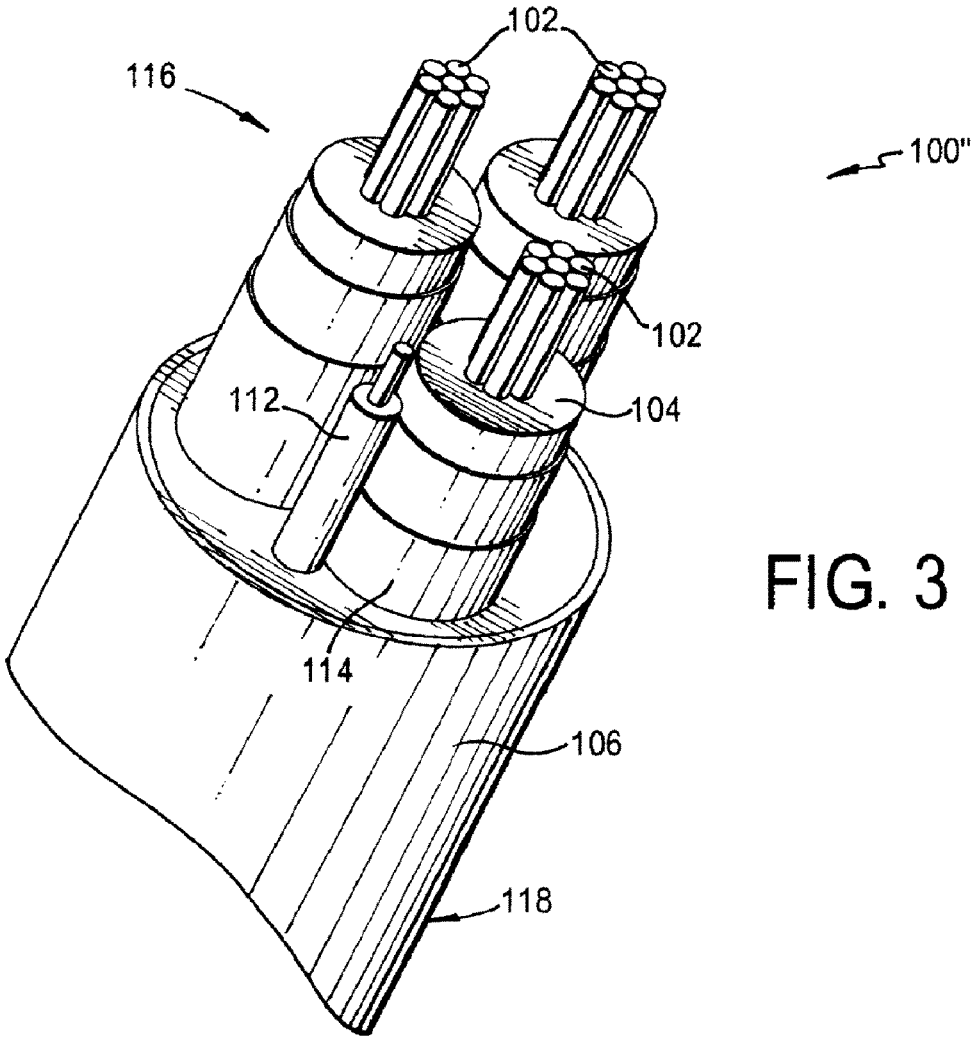
FIG. 3 depicts a perspective view of an electric cable according to one embodiment.

Referring to FIGS. 1A and 1B, certain electric cables 100 exhibiting high visibility can include a plurality of conductors 102 which can form a conductor core 116. Generally, the plurality of conductors 102 can be formed of any conductive material suitable for carrying a current, including, but not limited to, copper and aluminum. The conductor core 116 can have a variety of profiles, including flat, round, or trapezoidal profiles. In a flat profile, as depicted in FIG. 2, for example, the plurality of conductors 102 can be arranged in a parallel configuration. In a round profile, as depicted in FIGS. 1A, 1B and 3, the plurality of conductors 102 can generally be arranged in a bundle and can have a generally circular circumference. In a trapezoidal profile (not shown), the conductors 102 can be arranged to form a shape with four sides.

According to certain embodiments, electric cables 100 can have one or more insulation layers 104 disposed around all, or a portion, of the plurality of conductors 102. As illustrated in FIGS. 1A and 1B, multiple insulation layers 104 can also be included. In such embodiments, insulation layers can be applied around one, or more, of the bundles of plurality of conductors 102. Multiple bundles of conductors 102 can form the conductor core 116 in such embodiments. Generally, the insulation layers 104 can be formed from any suitable material including, for example, a synthetic rubber such as ethylene propylene rubber ("EPR"). Other materials can also, or alternatively, be used including, but not limited to, cross-linked polyethylene ("XLPE"), polyvinyl chloride ("PVC"), polytetrafluoroethylene ("PTFE"), polypropylene ("PP"), fluorinated ethylene propylene ("FEP"), polyether ether ketone ("PEEK"), ethylene propylene diene monomer ("EPDM") and the like. As can be appreciated, the insulation layers 104 can also provide the plurality of conductors 102 with additional protection against damage caused by external forces such as crushing.

In certain embodiments, and as depicted, for example, in FIG. 3, the cable 100 can also include a shielding layer 114. The shielding layer 114 can be applied around an insulation layer 104 to reduce shock hazards to individuals who come into contact with the electric cable 100. Any known shielding layer can be used, including, for example, a copper/textile braided shield, an overlapped copper tape shield, and an extruded thermoset semi-conducting layer.

As illustrated in FIGS. 1A, 1B and 3, electric cables 100 can further include one or more ground conductors 112 in the conductor core 116. For example, in certain embodiments, the conductor core 116 can have two or three ground conductors 112. The ground conductor(s) 112 can be formed of any material known in the art to provide suitable grounding, such as, for example, copper. In certain embodiments, the ground conductors 112 can be insulated with a known insulation material, such as, for example, polypropylene, ethylene propylene rubber ("EPR"), or ethylene propylene diene monomer ("EPDM"). The insulation material can be provided to ensure reliability of a ground circuit.

According to certain embodiments, the electric cable 100 can further include an outer jacket 106 which surrounds the conductor core 116. The outer jacket 106 can be formed of any conventional jacket material, such as, for example, polyvinyl chloride ("PVC"), chlorinated polyethylene ("CPE"), polyolefins, neoprene, chlorosulfonated polyethylene synthetic rubber ("CSM"), thermoplastic polyurethane ("TPU"), or a combination thereof. In certain embodiments, an outer jacket 106 can include a first layer and a second layer, each of which may be formed of the same material, or may be formed of two different materials, depending on the needs of the particular cable. In certain embodiments, the first layer can be called an 'inner jacket.'

According to certain embodiments, the outer jacket 106 can be highly visible for use in low-light environments. Specifically, high visibility can be imparted to the outer jacket 106 through the inclusion of high visibility particles into the cable jacket 106 or onto an exterior surface 118 of the cable jacket 106.

As can be appreciated, other electric cables can also exhibit high visibility. For example, in certain embodiments, an electric cable exhibiting high visibility can include a plurality of conductors 102 forming a conductor core 116, at least one insulation layer 104, and an outer jacket 106 as depicted, for example, in electric cables 100'-100" of FIGS. 2 and 3. Such cables 100' and 100" further illustrate the wide variety of cables that can exhibit high visibility. As can be appreciated, example cable constructions disclosed herein are not exhaustive of the types of cables which can incorporate the high visibility particles of the invention and generally any cable with an outer jacket layer can be adapted to be highly visible.

Cables with a high visibility jacket can be constructed in any suitable manner. For example, in certain embodiments, a cable 100 including a plurality of conductors 102, a conductor core 116 formed from the plurality of conductors 102, and one or more insulation layers 104 can be formed by applying the one or more insulation layers 104 around at least one of the plurality of conductors 102. The electric cable 100 can then have an outer jacket 106 formed over (e.g., via extrusion) the conductor core 116. In certain embodiments, additional steps can be completed to apply high visibility particles into the cable jacket 106 or onto an exterior surface 118 of the cable jacket 106.

As can be appreciated, additional components can be included in certain embodiments to provide a high visibility cable. For example, a shielding layer 114 can be applied over each insulation layer 104. Alternatively, or additionally, one or more grounding conductors 112 can also be included in the conductor core 116.

According to certain embodiments, a cable can be cured subsequent to applying the outer jacket. Curing of the cable can ensure the outer jacket is fully cured or formed and that high visibility particles are well attached to the outer jacket. In one example curing process, an outer jacket can be covered by a stiff mold. Generally, the stiff mold can allow the jacket to retain its shape and dimensions and can prevent self-adhesion when the cable is wound onto a take-up reel. Use of the stiff mold can also further promote cross-linking of the outer jacket.

A suitable mold can be formed of a material having melting temperature of about 200° F. to about 800° F. For example, in certain embodiments, the mold can be formed of lead metal, high-density polyethylene ("HDPE"), or polypropylene ("PP"). Mold curing can be performed at temperatures between 70° F. and 400° F. using cure times of about 1 hour to about 8 hours. In certain embodiments, a mold release can be applied to the cable jacket prior to applying the mold to prevent the mold from adhering to the jacket. Such a mold release can be a silicone based mold release.

High Visibility Particles

Electric cables can generally exhibit high visibility through the inclusion of high visibility particles in, or on the exterior surface of, an outer jacket. Generally any high visibility particles can be suitable including, for example, high visibility particles that are light reflective or luminescent.

Specific examples of light reflective particles can include standard reflective particles, retro reflective particles, or a combination thereof. 'Standard' reflective particles can include, for example, metallic particles that reflect and scatter light due to their metallic nature. As can be appreciated, retro reflective particles, in contrast, redirect and reflect incident light back to a light source along the same light path as the original light with minimal light scattering. As can be appreciated, retro reflective particles can exhibit bright light that is highly visible because little, to none, of the incident light is scattered.

Specific examples of luminescent particles can include fluorescent particles, photoluminescent particles, electroluminescent particles, bioluminescent particles, phosphorescent particles, and combinations thereof. Fluorescent and photoluminescent particles are particles made from materials that can absorb light, or other certain types of radiation, and then re-emit a brightly colored light. Bioluminescent particles are made from materials that produce light by incorporating a living organism, such as a fungi or other microorganism, that emits light. Phosphorescent particles can be made from materials that absorb radiation and then re-emit light for a certain period of time after the absorption occurs. A non-limiting example of such a phosphorescent material is a "glow-in-the-dark" material which glows for an extended period of time after absorbing light.

Electroluminescent particles can be formed of materials which emit light when subjected to an electric or magnetic field. As can be appreciated, this can provide notification of when a cable is in use and can alert workers to avoid handling the cable or exposing the cable to water.

In certain embodiments, high visibility particles can additionally, or alternatively, include brightly colored particles. Such high visibility particles can impart a bright color to a cable.

High visibility particles can generally be formed of any material that can exhibit a desired optical behavior. For example, high visibility particles can be formed of ceramic, silica, polyester glitter (e.g., Poly*Flake, polyester glitter, manufactured by Glitterex Corporation of Cranford, N.J.), barium titanate (e.g., Prizmalite P 2453 BTA manufactured by Prizmalite Industries Inc. of New York City, N.Y.), or a combination thereof. The particle surface can also be treated with various materials including, but not limited to, aluminum. As can be appreciated, the high visibility particles can be shaped in a variety of configurations and can include a spherical powder, a flake, or any other suitable structure. According to certain embodiments, a high visibility particle can have an average particle size of about 0.5 micron to about 300 microns. According to certain embodiments where the high visibility particles are flakes, the particles can have an average particle size of about 40 microns to about 300 microns.

Alternatively, or additionally, in certain embodiments, high visibility particles can be formed of glass or micro crystalline beads, such as, for example, reflective glass beads manufactured by Swarco Reflex Inc. of Mexia, Tex., 'Liquid Reflector' reflective glass beads manufactured by QEP Corporation of Knoxville, Tex., reflective glass beads manufactured by Cole Safety Products of Ashland, Ky., reflective glass spheres manufactured by Flex-O-Lite of PQ Corporation of Malvern, Pa., and reflective glass beads manufactured by Pacific Coast Paint & Sign Supply of Portland, Oreg. The glass or micro crystalline beads can be used either alone or in combination with a coating. According to certain embodiments, micro crystalline beads can have an average particle size of about 0.5 micron to about 10 microns. Glass beads can have an average particle size of about 0.5 to about 50 microns according to certain embodiments.

In certain embodiments, high visibility particles can also be provided in the form of a film or paint. Examples of such films and paints include photoluminescent films such as Permalight® manufactured by American PERMALIGHT, Inc. of Torrance, Calif., Film 7000PL, and ScotchLite™ Reflective Material—8830 Silver Marking Film, both manufactured by The 3M Company of St. Paul, Minn., ORALITE® 5910 manufactured by Orafol, Ga. and photoluminescent tape manufactured by EverGlow NA, Inc. of Matthews, N.C. In other examples, such films and paints can be electro luminescent films, such as, for example, tapes manufactured by EL International of London, England, Electro Luminescence Inc. of Aromas, Calif. and LumiLor paint, available from Darkside Scientific, LLC of Medina, Ohio. Alternatively, or additionally, suitable films or paints can include fluorescent materials. For example, high visibility particles can be included in a fluorescent paint manufactured by Rosco Laboratories Inc. of Stamford, Conn.

Any of the various high visibility particles can be imparted to the outer jacket in a number of ways. For example, in certain embodiments, the outer jacket can include high visibility particles applied directly to an exterior surface thereof. In other certain embodiments, the outer jacket can include an additional coating that is applied to an exterior surface of the outer jacket. The additional coating can include the high visibility particles. Alternatively, in certain embodiments, an outer jacket can include an extruded compound having the high visibility particles. The compound can be extruded as a component of the outer jacket or can be extruded over the exterior surface of the outer jacket. Alternatively, in certain embodiments, the high visibility particles can be added to a cable through an attached tape or film.

Additional details about each such method of incorporating the high visibility particles into a cable are discussed further below.

Direct Application of the High Visibility Particles to the Jacket Surface

In certain embodiments, high visibility particles can be applied directly to an exterior surface of an outer jacket. In such embodiments, high visibility particles can be applied without incorporating the high visibility particles into either the jacket materials or into a coating compound.

In certain direct attachment embodiments, a film transfer method can be used to apply the high visibility particles. In certain such film transfer methods, a backing film can be provided which includes suitable high visibility particles in either an adhesive layer or directly attached to the backing film through an adhesive on the high visibility particles.

Generally, such backing films can be formed of any suitable material including, but not limited to, PVC, polyethylene, chlorotrifluoroethylene, polyvinylidene fluoride, acrylic, polypropylene, siloxane, polyester fabric, polystyrene, paper cloth, or a combination thereof. According to certain embodiments, the backing film can have a thickness of about 1 micron to about 500 microns. According to certain embodiments, a curable film layer can additionally be applied to a surface of the backing film. The curable film layer may be formed of any material known in the art, including, but not limited to, CPE, polyethylene, polypropylene, siloxane, polyester, fluoro polymers, acrylic, and a combination thereof. The curable film layer can be substantially transparent and can provide durability to the underlying high visibility particles.

In certain film transfer embodiments, an adhesive layer containing high visibility particles can be applied to a surface of the backing film. Where the backing film also has a curable film layer, the adhesive layer can be applied on top of the curable film layer. The adhesive layer can be formed of any adhesive material known in the art, such as, for example, acrylic, epoxy, urethane, ester, silicone, and a combination thereof. In certain embodiments, the adhesive material can be a dry adhesive and can cure without evaporation of a solvent. For example, in certain embodiments, the adhesive can be permanently affixed through a heat curing process. The high visibility particles can be distributed uniformly across the surface of the backing film, or can be selectively applied only in certain areas so as to, for example, spell out, or form, indicia.

In certain film transfer methods, high visibility particles can alternatively be coated with an adhesive, such that the high visibility particles are directly adhered to the backing film. Accordingly, in such embodiments, a separate adhesive layer is not needed. The adhesive applied to the high visibility particles can be formed of the same adhesive material used to form the adhesive layer on the backing film as previously described herein.

In certain backing film embodiments, the backing film (including the high visibility particles) can be directly applied to an exterior surface of the outer jacket for an electric cable. As can be appreciated, the backing film can be applied in any pattern which is desirable, so long as the backing film is adhered to an exterior surface of the outer jacket. For example, the backing film can be helically applied around an electrical cable. By applying one, or more of pressure and heat to the backing film, the high visibility particles (which are either dispersed within an adhesive layer or directly adhered to the backing film with an adhesive) can be transferred to an exterior surface of the outer jacket.

According to certain embodiments, a cable can be further mold cured after application of the backing film. The heat and pressure inherent to a mold curing process can allow for very strong bonding of the high visibility particles to the outer jacket. In certain such embodiments, once the cable is mold cured, the backing film can be removed, leaving behind only the high visibility particles on an exterior surface of the outer jacket. Alternatively, in certain embodiments, the backing film can remain adhered to an exterior surface of the other jacket. In certain embodiments, the high visibility particles can cover 5% or more of the total surface area of the exterior surface of the outer jacket. In certain embodiments, about 80% or less of the outer jacket can be covered by the high visibility particles. In certain embodiments including a curable film, the curable film can remain adhered to the exterior surface as the outermost layer (i.e., over the high visibility particles). As can be appreciated, the curable film layer can act as a protective layer and can prevent abrasion damage to the outer jacket or high visibility particles.

As can be appreciated, a cable jacket can also be embossed with letters, numbers, or other markings used to identify the cable type, functional rating, and other characteristics. Such indicia can be applied via an embossing tape. Such an embossing tape can be formed of, for example, polyamide, polyester, polypropylene, or metal. When such indicia are to be applied to the exterior surface of the jacket, the embossing tape can be applied before application of the backing film. Because such embossing tapes are flexible and heat resistant, they can be mold cured with a cable. After the curing process, the embossing tape can be removed from the cable.

According to certain embodiments, high visibility particles can also be directly applied to an outer jacket of a cable through a particle deposition method. In such embodiments, the high visibility particles can be directly applied to the exterior surface of the outer cable without the use of a resin or coating or can be applied as a colloidal mixture. Specific particle deposition methods of applying the high visibility particles to the jacket include spraying, the use of a fluidized bed method, and the use of an electrostatic deposition method.

In certain direct application methods, an easy clean outer layer can additionally be applied over the high visibility particles on the exterior surface of the outer jacket. In such embodiments, the easy clean outer layer can be made of a material based on a liquid composition containing a polymer resin and, optionally a fatty acid amide, such as the easy clean layer disclosed in Applicants' co-pending application Ser. No. 14/209,613 filed on Mar. 13, 2014, which is herein incorporated by reference. The easy clean layer can be applied over the high visibility particles via painting, spraying, or dip coating. The easy clean layer can be easy to clean and can be resistant to dirt, owing in part to its low porosity. As can be appreciated, a low porosity can improve the visibility of a cable when used, for example, in a dimly lit location, such as a mine.

High Visibility Compound Applied by Coating

In other certain embodiments, high visibility particles can be applied through a coating process. In such embodiments, a coating containing the high visibility particles can be applied to an exterior surface of the jacket. The coating can be formed of a suitable binder resin. Such binder resins can be transparent and can be formed of silicone, fluoro resin, acrylic, epoxy, ester resin, urethane, or a combination thereof. In certain embodiments, the binder resin can be highly abrasion-resistant and can provide the outer jacket with improved protection against damage. According to certain embodiments, the coating can include about 1 weight % to about 20 weight % of the high visibility particles. In certain embodiments, the coating can include about 10 wt % to about 20 wt % of the high visibility particles.

The coating can be applied to the exterior surface of the jacket via painting, spraying, printing, dipping, extruding, a flooded die method, or any other known methods for applying a composition to a polymer substrate. The coating can then be cured or dried before the cable is mold-cured.

High Visibility Compound Extruded with or on Outer Jacket

In other certain embodiments, a high visibility compound containing the high visibility particles can be extruded as an integral component of the jacket compound. Such a high visibility compound can be formed from a polymer, such as, for example, PVC, CPE, polyolefins, neoprene, CSM, TPU, or a combination thereof. The high visibility compound can additionally contain about 1 wt % to about 20 wt % of the high visibility particles. In certain embodiments, the high visibility compound can include about 5 wt % to about 10 wt % of the high visibility particles.

The high visibility particles can be combined with the jacket compound by mixing the two components together with a mill or commercially available mixer. The resulting mixture can then be extruded over a conductor core to form a high visibility outer jacket. As can be appreciated, this method eliminates the need to apply a coating or backing tape to the jacket. As can be further appreciated, the cable jacket can also withstand wear and tear and can slow degradation because the high visibility particles are dispersed throughout the entire jacket compound and not only an exterior surface.

In certain embodiments, the high visibility compound can alternatively be extruded over the exterior surface of the jacket after the jacket has been formed. As can be appreciated, the high visibility compound can be extruded over the entire surface of the jacket, or it can be extruded only is discrete stripes of material as depicted, for example, in FIG. 1A as stripes 110. In embodiments applying the high visibility compound in the form of stripes, such stripes can be applied helically or longitudinally across the length of the cable or can be applied circumferentially around the diameter of the cable, such that they cover only a portion of the exterior surface of the jacket.

In certain such embodiments, a two-layer tandem extrusion process can be used, whereby a first layer is extruded over the conductor core, followed by a second layer, to form the outer jacket. The second layer can incorporate the high visibility compound. Alternatively, in certain embodiments, the high visibility compound can be extruded as a third layer over the exterior surface of the jacket when the jacket already contains two layers.

High Visibility Particles Attached with Tape or Film

In certain embodiments, a tape or film containing the high visibility particles can be adhered to an exterior surface of a cable (e.g., outer jacket) with an adhesive. Such a tape or film can be constructed from any material of suitable durability including, for example, any of the materials suitable for a backing film in the previously described tape transfer methods. Likewise, the attached tape or film can have a similar thickness to certain backing films of the tape transfer method and can have, for example, a thickness of about 1 micron to about 500 microns. A non-limiting example of a suitable tape or film is a film constructed from polyester fabric or paper cloth having a thickness of about 150 microns.

The adhesive of an attached tape or film can be selected to ensure that the tape or film remains firmly attached over the lifetime of the cable. In certain embodiments, such adhesives can include the adhesives used with a backing film as described herein.

In certain embodiments, the adhesive can be further strengthened by a heat or mold-curing process. The heat and pressure inherent to a mold-curing process can, as previously described, allow for very strong bonding of the tape or film to a cable and can overcome the difficulties of prior reflective tapes to remain adhered to a cable. The use of a mold-curing process can also allow hot melt adhesives to be used. As can be appreciated, a hot melt adhesive can allow an attached tape or film to forego a release liner because hot melt adhesives are inherently non-tacky at room temperature. If, however, a release liner is required for a particular adhesive, any known release film or liner can be used including, for example, release liners produced from chlorinated polyethylene, polyethylene, polypropylene, siloxane, polyester, polyvinylidene fluoride, polytetrafluoroethylene, fluoro polymers, paper, acrylic, wax, or the like can be used. Commercial release liners can alternatively be used.

As can be appreciated, variations to the attached tape or film are also possible. For example, in certain embodiments, a transparent layer can be included over the high visibility particles to provide additional durability or cleanability to the cable. Generally, a transparent layer can be constructed from known materials including, for example, polyurethane, polyvinylidene fluoride, polytetrafluoroethylene, acrylics, polyvinyl chloride, and polyester.

In certain variations, the high visibility particles can be distributed uniformly across the attached tape or film. However, in other certain embodiments, the high visibility particles can be selectively applied to the tape or film so as to, for example, form indicia or the like. In certain embodiments, the attached tape or film can cover about 80%, or less, of the total outer surface area of the cable. The attached tape or film can be applied to the cable in any pattern which is desirable including, for example, helical and striped arrangements.

As can be appreciated, a highly visible cable can be produced without the durability or cleanability problems inherit to existing designs. The high visibility components of such cables can have a longer lifetime, as the high visibility particles are incorporated into the jacket or are adhered to the cable through a strong bond. Additionally, protective coatings can be applied to further protect against abrasion.

The dimensions and values disclosed herein are not to be understood as being strictly limited to the exact numerical values recited. Instead, unless otherwise specified, each such dimension is intended to mean both the recited value and a functionally equivalent range surrounding that value.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Every document cited herein, including any cross-referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests, or discloses any such invention. Further, to the extent that any meaning or definition of a term in this document conflicts with any meaning or definition of the same term in a document incorporated by reference, the meaning or definition assigned to that term in the document shall govern.

The foregoing description of embodiments and examples has been presented for purposes of description. It is not intended to be exhaustive or limiting to the forms described. Numerous modifications are possible in light of the above teachings. Some of those modifications have been discussed and others will be understood by those skilled in the art. The embodiments were chosen and described for illustration of various embodiments. The scope is, of course, not limited to the examples or embodiments set forth herein, but can be employed in any number of applications and equivalent articles by those of ordinary skill in the art. Rather it is hereby intended the scope be defined by the claims appended hereto.

What is claimed is:

1. An electrical cable comprising: a plurality of conductors forming a conductor core;

one or more insulation layers at least partially surrounding at least one of the plurality of conductors;

an outer jacket surrounding the conductor core, the outer jacket comprising an exterior surface; and a film applied to the exterior surface of the outer jacket, the film comprising from about 10% to about 20%, by weight, of high visibility particles; and an easy clean layer applied over the film applied to the exterior surface of the outer jacket, the easy clean layer comprising a polymeric resin and optionally a fatty acid amide; and wherein the film further comprises an adhesive configured to adhere the film to the exterior surface of the outer jacket.

2. The electrical cable of claim 1, wherein the high visibility particles have an average particle size of about 0.5 micron to about 300 microns.

3. The electrical cable of claim 1, wherein the film comprises a substrate layer, the substrate layer comprises one or more of polyvinyl chloride, polyethylene, chlorotrifluoroethylene, polyvinylidene fluoride, acrylic, polypropylene, siloxane, polyester fabric, polystyrene, and paper cloth.

4. The electrical cable of claim 3, wherein the high visibility particles are attached to the substrate layer.

5. The electrical cable of claim 1, wherein the film has a thickness of about 1 micron to about 500 microns.

6. The electrical cable of claim 1, wherein the adhesive comprises one or more of acrylic, epoxy, urethane, ester, and silicone.

7. The electrical cable of claim 1, wherein the film further comprises a transparent layer.

8. The electrical cable of claim 1, wherein the high visibility particles are light reflective particles or luminescent particles.

9. The electrical cable of claim 8, wherein the high visibility particles are light reflective and comprise one or more of aluminum coated ceramic particles and glass beads particles.

10. The electrical cable of claim 8, wherein the light reflective particles are selected from the group consisting of reflective particles, retro reflective particles, and combinations thereof; and the luminescent particles are selected from the group consisting of fluorescent particles, photoluminescent particles, phosphorescent particles, bioluminescent particles, electroluminescent particles, and combinations thereof.

11. The electrical cable of claim 1, wherein the outer jacket and the film are mold-cured.

12. The electrical cable of claim 1, wherein the film is helically applied to the exterior surface of the outer jacket and the film covers about 80% or less of the outer jacket.

13. The electrical cable of claim 1, further comprising one or more shielding layers, each of the one or more shielding layers surrounding one of the one or more insulation layers.

14. The electrical cable of claim 1, further comprising at least one grounding conductor.

15. The electrical cable of claim 1, wherein the conductor core has a flat, round, or trapezoidal profile.

* * * * *